US006701879B2

(12) United States Patent
Diehl et al.

(10) Patent No.: US 6,701,879 B2
(45) Date of Patent: Mar. 9, 2004

(54) INTERNAL COMBUSTION ENGINE

(75) Inventors: Udo Diehl, Stuttgart (DE); Bernd Rosenau, Tamm (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/253,232

(22) Filed: Sep. 24, 2002

(65) Prior Publication Data

US 2003/0070644 A1 Apr. 17, 2003

(30) Foreign Application Priority Data

Sep. 26, 2001 (DE) ..... 101 47 305

(51) Int. Cl.[7] ..... F01L 1/26

(52) U.S. Cl. ..... 123/90.22; 123/90.23; 123/90.25; 123/90.12

(58) Field of Search ..... 123/90.22, 90.23, 123/90.24, 90.25, 90.1, 90.11, 90.12, 90.15, 90.17

(56) References Cited

U.S. PATENT DOCUMENTS 4,485,780 A * 12/1984 Price et al. ..... 123/321
4,593,662 A * 6/1986 Baring et al. ..... 123/198 F
5,636,602 A * 6/1997 Meister ..... 123/90.12
5,709,178 A * 1/1998 Feucht ..... 123/90.12
5,787,849 A * 8/1998 Mitchell ..... 123/90.17
5,794,576 A * 8/1998 Hara et al. ..... 123/90.16
6,386,161 B2 * 5/2002 Pierik ..... 123/90.16

FOREIGN PATENT DOCUMENTS

DE 198 26 074 3/2000

* cited by examiner

*Primary Examiner*—Thomas Denion
*Assistant Examiner*—Ching Chang
(74) *Attorney, Agent, or Firm*—Kenyon & Kenyon

(57) ABSTRACT

An internal combustion engine having at least one combustion cylinder that includes a combustion chamber provided with gas-exchange valves, and an electrohydraulic valve control device having valve actuators that actuate the gas-exchange valves. To reduce manufacturing costs and/or the installation space required for the electrohydraulic valve control device, at least two synchronously controlled gas-exchange valves are connected using a coupling element to a common valve actuator, and the connection sites of the gas-exchange valves are flexibly formed on the coupling element.

10 Claims, 2 Drawing Sheets

INTERNAL COMBUSTION ENGINE

FIELD OF THE INVENTION

The present invention is directed to an internal combustion engine.

BACKGROUND INFORMATION

An internal combustion engine referred to in German Published Patent Application No. 198 26 074 includes an electrohydraulic valve control device, including valve actuators configured as hydraulic actuators, each of these actuating one of the gas-exchange valves. Each hydraulic actuator may have a double-acting working cylinder in which an operating piston may be guided in an axially displaceable manner. The operating piston may be rigidly connected to a piston rod, which may be guided out of the working cylinder and, itself, may be rigidly connected to the valve tappet of a gas-exchange valve or may be formed in one piece with it.

SUMMARY OF THE INVENTION

An exemplary internal combustion engine according to the present invention may provide two gas-exchange valves that are operated using a single valve actuator. In this context, the closing and opening of both gas-exchange valves may be reliably ensured, regardless of any existing component tolerances. In particular, it may be ensured that the valve elements of both gas-exchange valves in the valve closed position tightly abut the valve seat, so that the combustion chamber of the combustion cylinder may be reliably sealed. By economizing one valve actuator per combustion cylinder, the manufacturing costs for the internal combustion engine's valve control device may be reduced.

According to one exemplary embodiment of the present invention, the valve actuator may have a double-acting hydraulic working cylinder, including an operating piston that may be guided in the working cylinder in an axially displaceable manner, as well as a piston rod that may be rigidly connected to the operating piston and led through the working cylinder. The coupling element may be fastened to the piston rod's rod section which is led through the working cylinder by a swivel bearing, a swiveling axis being oriented transversely to the stroke direction of the operating piston.

The flexible connection sites may be formed so that the gas-exchange valves in the connection sites may perform at least a pendulum motion and a translatory shifting motion in each case relative to the coupling element and transversely to the stroke direction of the operating piston. In the case of two gas-exchange valves actuated by the valve actuator, the connection sites for both gas-exchange valves may be located on the coupling element on both sides of the swivel bearing. This structural configuration may ensure that both gas-exchange valves are reliably closed, even if due to component tolerances and thermal expansions, the valve elements of both gas-exchange valves do not simultaneously place themselves against their associated valve seat in the combustion cylinder.

If the valve element of the one gas-exchange valve abuts on the valve seat, the operating piston may not be blocked in its stroke motion and may move further due to the swivel bearing between the piston rod and coupling element, with result that the coupling element performs a swiveling motion until the valve element of the second gas-exchange valve also abuts the valve seat. In this context, the pendulum and translatory shifting support of the valve stems of both gas-exchange valves in the connection sites may prevent a blockage of the swiveling motion of the coupling element since the coupling element may position itself at an angle with respect to the valve stems without lateral forces being applied to the valve stems.

DETAILED DESCRIPTION

Figure 1:
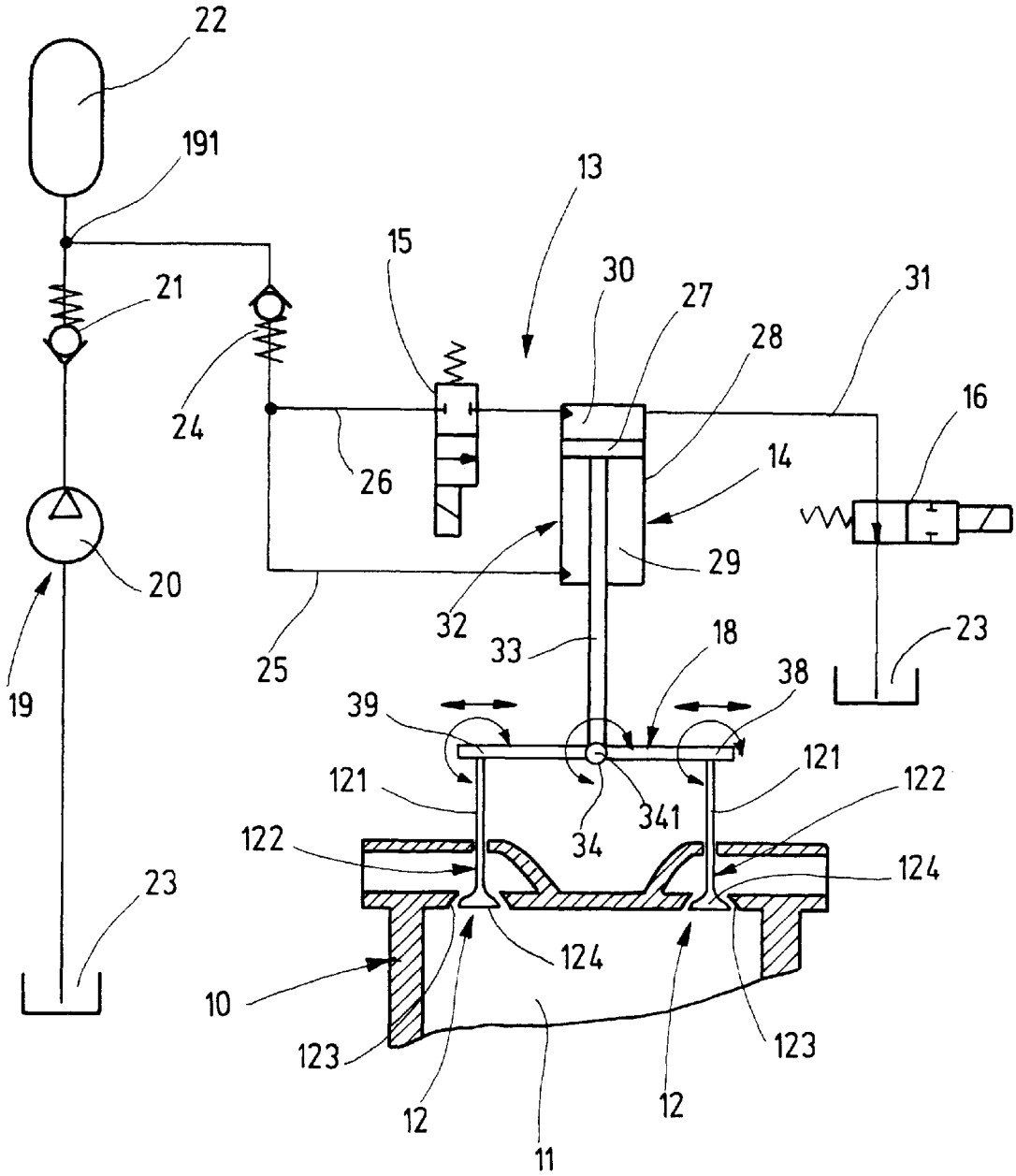
FIG. 1 shows, in cutaway portions, a longitudinal section of a combustion cylinder of an internal combustion engine having two gas-exchange valves, as well as a block diagram of an electrohydraulic valve control device for the gas-exchange valves.

The internal combustion engine for a motor vehicle may have four or more combustion cylinders 10. One of these is shown schematically in a longitudinal section, in cutaway portions, in FIG. 1. A combustion chamber 11, provided with gas-exchange valves 12 for controlling an intake and discharge cross-section, is formed in combustion cylinder 10. Of gas-exchange valves 12, the exemplary embodiment of FIG. 1 shows two discharge valves controlling a discharge cross-section of combustion chamber 11. For the sake of clarity, the intake valves likewise present on combustion chamber 11 for controlling an intake cross-section were omitted in FIG. 1. Both gas-exchange valves 12 are actuated synchronously, i.e. simultaneously opened and closed. Each gas-exchange valve 12 has a valve element 122 including a valve closing member 124, which is seated on an axially displaceably guided valve stem 121 and which cooperates with a valve seat 123 enclosing the discharge cross-section in combustion cylinder 10. By displacing valve stem 121 in one or the other axial direction, valve closing member 124 lifts off from valve seat 123 or places itself on it.

Both gas-exchange valves 12 are actuated by an electrohydraulic valve control device 13 shown in the block diagram in FIG. 1. The valve control device has a valve actuator 14, also known as a hydraulic actuator, which is controllable by control valves 15, 16, and to which both gas-exchange valves 12 are linked by a coupling element 18. Also belonging to valve control device 13 are a pressure supply device 19 which includes, for example, an adjustable high-pressure pump 20 which delivers fluid from a fluid reservoir 23, a return valve 21 and an accumulator 22 for pulsation attenuation and energy storage. At outlet 191 of pressure supply device 19, a permanent adjustable high pressure may be present.

Valve actuator 14 is configured as a double-acting working cylinder 32, including a cylinder housing 28 and an operating piston 27 guided therein in an axially displaceable manner, which subdivides the interior space of cylinder housing 28 into a first pressure chamber 29 and a second pressure chamber 30. First pressure chamber 29 is connected to a first pressure line 25, and second pressure chamber 30 both to a second pressure line 26 as well as to a return line 31. Both pressure lines 25, 26 are connected via a common return valve 24 to outlet 191 of pressure supply device 19. First control valve 15 is connected into second pressure line 26 and second control valve 16 is connected into return line 31 which runs into fluid reservoir 23. Both control valves 15, 16 are configured as 2/2 diverter solenoid valves.

As shown in FIG. 1, first control valve 15 is closed, and second control valve 16 is opened. The high pressure prevailing in first pressure chamber 29 may ensure that operating piston 27 is located in the top dead-center position, so that gas-exchange valves 12 are kept in their closed position. If control valves 15, 16 are switched over, second pressure chamber 30 is shut off from return line 31, and the high pressure at outlet 191 of pressure supply device 19 is applied to second pressure chamber 30. Since the area of operating piston 27 that limits second pressure chamber 30 is greater than the area of operating piston 27 limiting first pressure chamber 29, operating piston 27 moves downwards, and both gas-exchange valves 12 are opened. In this context, the magnitude of the opening stroke depends on the formation of the electrical control signal applied to first control valve 15, and the opening speed depends on the fluid pressure injected by pressure supply device 19.

Figure 2:
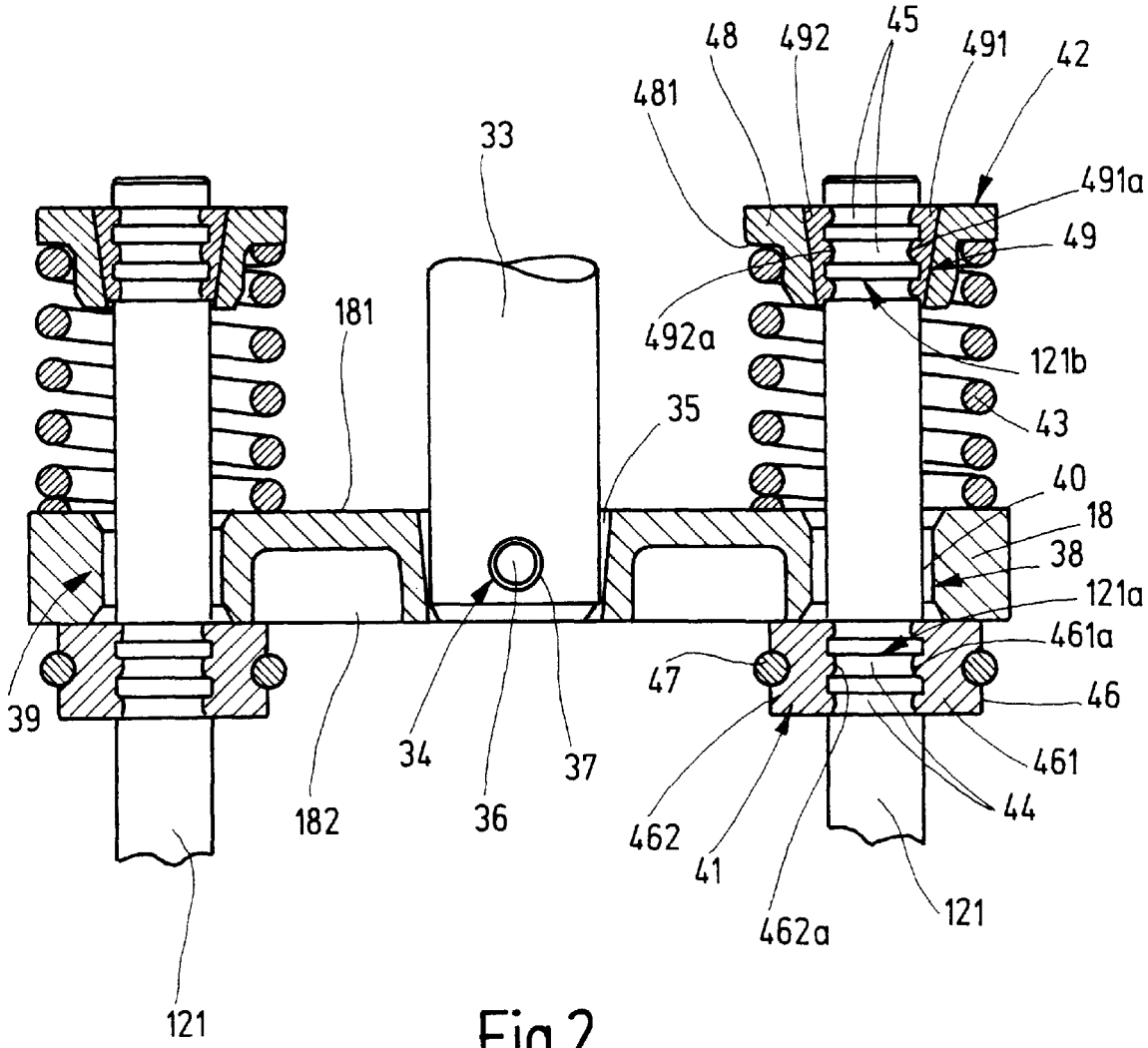
FIG. 2 shows, in cutaway portions, an enlarged display of a coupling element between a valve actuator of the valve control device and the gas-exchange valves.

Coupling element 18, which may be formed as a rectangular plate, is fastened at the end of a piston rod 33 that is rigidly joined to operating piston 27 and led through cylinder housing 28 of working cylinder 32 by a swivel bearing 34, with a swiveling axis 341 oriented transversely to the stroke direction of operating piston 27. As may be recognized from the enlarged sectional view of coupling element 18 in FIG. 2, the rod end of piston rod 33 dips into a recess 35 centrally disposed in coupling element 18 where swivel bearing 34 is positioned. To enable a swiveling motion of coupling element 18 on piston rod 33, recess 35 is formed in such a manner that it tapers towards the end of piston rod 33. Swivel bearing 34 is integrated in recess 35 and is made up of a cylinder pin 36 which is inserted into bore holes aligned with one another in piston rod 33 and in coupling element 18. In FIG. 2, only bore hole 37 which is introduced into piston rod 33 may be seen. Bore hole 37 is positioned between cylinder pin 36 and bore hole wall 37 in a manner that provides some play, enabling the rotary motion of coupling element 18. The fit between cylinder pin 36 and the bore holes in coupling element 18 may be an interference fit, so that the pin may not drift out of the bore holes.

The connection of both gas-exchange valves 12 to coupling element 18 is handled flexibly for tolerance compensation, connection sites 38, 39 being disposed between valve stems 121 of gas-exchange valves 12 and coupling element 18 on both sides of swivel bearing 34 at the same distance from swivel bearing 34. In this context, each connecting site 38, 39 is formed so that valve stem 121 of gas-exchange valve 12 in connecting site 38, 39 may perform at least a swiveling or pendulum motion and a translatory shifting motion, in each case relative to coupling element 18 and transversely to the stroke direction of operating piston 27.

As may be seen in the enlarged sectional view, in cutaway portions in FIG. 2, of valve stems 121 of gas-exchange valves 12 and piston rod 33 of working cylinder 32, in each connecting site 38, 39, coupling element 18 has an elongated hole 40 extending transversely to the stroke direction of piston rod 33 through which is guided a valve stem 121 of one of gas-exchange valves 12. Valve stem 121 is accommodated with a stem section 121*a* disposed at a distance from the end of valve stem 121 in a pendulum bearing 41 and bears a spring plate 42 on a stem section 121*b* disposed at the stem end of valve stem 121. Between spring plate 42 and coupling element 18, a compression spring 43 slid over valve stem 121 is supported with prestressing action.

In stem section 121*a* accommodated by pendulum bearing 41 and also in stem section 121*b* supporting spring plate 42 of valve stem 121 of each gas-exchange valve, grooves 44 or rather 45 are recessed, this being in the exemplary embodiment of FIG. 2 in each case three grooves 44 or rather 45. Pendulum bearing 41 has two half-rings 461 and 462 enclosing stem section 121*a* which meet at the end faces and are joined to form a closed ring 46 held together by a tension ring 47.

Formed on the inner surface of both half-rings 461, 462, are radially protruding semicircular ring lands 461*a* or rather 462*a*, which are set apart from one another in the axial direction and which engage with clearance in grooves 44 in stem section 121*a* of valve stem 121 in manner that allows valve stem 121 to execute a rotary motion about its longitudinal axis. Ring 46 is non-positively placed by compression spring 43 against lower face 182 of coupling element 18 turned away from spring support surface 181.

Spring plate 42 includes a collar 48 on which radially outwards-facing support surfaces 481 are formed. Collar 48 is slid in a positive locking manner on a cone 49 having a diameter that increases towards the stem end of valve stem 121. Cone 49 is made up of two groove wedges 491, 492 which are held together by a slid-on collar 48. Provided on each groove wedge 491, 492, are three radially protruding, semicircular ring lands 491*a* or rather 492*a*, which are set apart from one another in the axial direction and extend with clearance into grooves 45 in stem section 121*b* of valve stem 121 in such a manner that the rotary mobility of valve stem 121 about its longitudinal axis is retained.

Due to the prestressing force of compression spring 43, collar 48 is pressed upwards far enough to produce a secure connection between groove wedges 491, 492 and valve stem 121. Compression spring 43 is prestressed in such a manner that gas-exchange valve 12, as long as it does not abut valve seat 123 with its valve element 121, follows the motion of coupling element 18. Because of pendulum bearing 41 and the associated possibility of a pendulum motion of valve stem 121, elongated hole 40 which enables a translatory displacement of valve stem 121 within couple element 18, and because of the deformability of compression spring 43, a swiveling motion of coupling element 18 in swivel bearing 34 may be possible in a limited range and may not be blocked or cramped by valve stems 121.

If, due to change-over of control valves 15, 16, operating piston 27 moves downwards out of its top dead-center position shown in FIG. 1, then both gas-exchange valves 12 with their valve closing members 124 are lifted off of valve seats 123 via coupling element 18 and opened synchronously. To close gas-exchange valves 12, control valves 15, 16 are returned to the position shown in FIG. 1. In this manner, second pressure chamber 30 is connected to return line 31 and depressurized. Operating piston 27 moves upwards in FIG. 1, and, via coupling element 18, gas-exchange valves 12 are actuated in the closing direction in such a manner that valve elements 122 are drawn upwards and valve closing members 124 place themselves on valve seats 123. Due to component tolerances and heat expansions, however, valve closing members 124 of both valve elements 122 may not place themselves simultaneously on the associated valve seats 123.

If valve closing member 124 of the one gas-exchange valve 12 abuts valve seat 123, operating piston 27 may nevertheless move further since coupling element 18 may perform a swiveling motion in its swivel bearing 34 which may not be hindered by the flexible connection of valve stems 121 in connection sites 38, 39. It thus may be ensured that, at the end of the stroke of operating piston 27, both valve closing members 124 of gas-exchange valves 12 abut their associated valve seat 123 and, in this manner, gas-exchange valves 12 may be reliably closed. The symmetrical configuration of connection sites 38, 39 with respect to swiveling axis 341 of swivel bearing 34 may ensure equal closing forces on both gas-exchange valves 12.

Alternatively, for example, gas-exchange valves 12 synchronously controlled by coupling element 18 may not have to be associated with one single combustion cylinder 10. Instead, they may also be mounted on combustion chambers 11 of different combustion cylinders 10. When using gas-exchange valves 12 as discharge valves, for example, in a four-cylinder internal combustion engine, the discharge valves of the first and the third combustion cylinder may be connected in the described manner to coupling element 18 for common actuation by a valve actuator 14 of valve control device 13.

The jointly actuated gas-exchange valves 12 may have the function of intake valves, as well as of discharge valves.

What is claimed is:

1. An internal combustion engine comprising:

at least one combustion cylinder including a combustion chamber having at least two synchronously controlled gas-exchange valves to control an intake and discharge cross-section;

a valve control device having a common valve actuator to actuate the at least two synchronously controlled gas-exchange valves; and a coupling arrangement to connect the at least two synchronously controlled gas-exchange valves to the common valve actuator, the at least two synchronously controlled gas-exchange valves including connection sites that are flexibly formed on the coupling arrangement;

wherein the common valve actuator includes a double-acting hydraulic working cylinder having an operating piston that is guided in the working cylinder in an axially displaceable manner and a piston rod that is rigidly connected to the operating piston, the piston rod having a rod section that is fastened to the coupling arrangement and includes a swivel bearing with a swiveling axis oriented transversely to a stroke direction of the operating piston, the swivel bearing being configured to guide the rod section out of the working cylinder.

2. The internal combustion engine of claim 1, wherein the swivel bearing includes a plurality of bore holes arranged in an aligned manner in the piston rod and the coupling arrangement, and a cylinder pin inserted into the plurality of bore holes.

3. The internal combustion engine of claim 1, wherein the connection sites are arranged on both sides of the swivel bearing at a same distance from the swivel bearing.

4. The internal combustion engine of claim 1, wherein each connecting site is formed so that the gas-exchange valves at the connection sites are able to perform at least a pendulum motion and a translatory shifting motion, in each case relative to the coupling arrangement and transversely to the stroke direction of the operating piston.

5. The internal combustion engine of claim 4, wherein at each of the connecting sites:

the gas-exchange valves include a valve stem to bear a spring plate at a free stem end, the valve stem including a stem section to accommodate the valve stem in a pendulum bearing, a compression spring being supported between the spring plate and the coupling arrangement; and the coupling arrangement includes a spring support surface and a surface face turned away from the spring support surface, the pendulum bearing being arranged non-positively against the surface face, the coupling arrangement including an elongated hole in each connecting site extending to the stroke direction of the operating piston and through which the valve stem is guided.

6. The internal combustion engine of claim 5, wherein the valve stem includes at least one groove recessed in the stem section and the pendulum bearing includes two half-rings arranged to enclose the stem section and meet at end faces, the two half-rings each having an inner surface and at least one radially protruding, semi-circular ring land formed on the inner surface to engage into the at least one groove, the pendulum bearing including a tension ring to enclose the two half-rings that form a closed ring.

7. The internal combustion engine of claim 5, wherein:

the valve stem includes an end section bearing the spring plate and at least one groove recessed in the end section, and the spring plate includes two groove wedges that each have at least one semicircular ring land to engage in the at least one groove recessed in the end section, a cone formed by the two groove wedges to enclose the end section and having a diameter that increases towards a stem end, and a collar slid in a positive locking manner onto the cone and having a support surface for the compression spring.

8. The internal combustion engine of claim 6, wherein a play is provided between the at least one groove and the at least one radially protruding, semi-circular ring land to permit a rotary motion of the valve stem about its longitudinal axis.

9. The internal combustion engine of claim 7, wherein a play is provided between the at least one groove and the at least one radially protruding semicircular ring land to permit a rotary motion of the valve stem about its longitudinal axis.

10. The internal combustion engine of claim 1, wherein the coupling arrangement includes a rectangular plate having a central recess, the piston rod includes a rod end configured to dip into the central recess, and the swivel bearing is positioned in the central recess.

* * * * *